US010992069B2

(12) United States Patent
Kudo

(10) Patent No.: US 10,992,069 B2
(45) Date of Patent: Apr. 27, 2021

(54) TERMINAL BLOCK

(71) Applicant: Sumitomo Wiring Systems, Ltd., Mie (JP)

(72) Inventor: Yasuhiro Kudo, Mie (JP)

(73) Assignee: Sumitomo Wiring Systems, Ltd.

( * ) Notice: Subject to any disclaimer, the term of this patent is extended or adjusted under 35 U.S.C. 154(b) by 0 days.

(21) Appl. No.: 16/618,938

(22) PCT Filed: Jun. 19, 2018

(86) PCT No.: PCT/JP2018/023208

§ 371 (c)(1),
(2) Date: Dec. 3, 2019

(87) PCT Pub. No.: WO2019/009056

PCT Pub. Date: Jan. 10, 2019

(65) Prior Publication Data

US 2020/0144741 A1 May 7, 2020

(30) Foreign Application Priority Data

Jul. 4, 2017 (JP) ..... JP2017-131045

(51) Int. Cl.
*H01R 13/52* (2006.01)
*H01R 9/24* (2006.01)
(Continued)

(52) U.S. Cl.
CPC ..... *H01R 9/24* (2013.01); *H01R 9/18* (2013.01); *H01R 13/405* (2013.01); *H01R 13/512* (2013.01); *H01R 13/621* (2013.01)

(58) Field of Classification Search
CPC ..... H01R 9/24; H01R 9/18; H01R 13/405; H01R 13/512; H01R 13/621; H01R 13/02; H01R 4/30
(Continued)

(56) References Cited

U.S. PATENT DOCUMENTS 7,094,098 B2 * 8/2006 Miyazaki ..... H01R 4/46 439/550
7,264,506 B2 * 9/2007 Mori ..... H01R 11/03 439/559
(Continued)

FOREIGN PATENT DOCUMENTS

JP 2012-256573 12/2012
JP 2013-502025 1/2013
(Continued)

OTHER PUBLICATIONS

International Search Report dated Aug. 21, 2018.

*Primary Examiner* — Abdullah A Riyami
*Assistant Examiner* — Nelson R. Burgos-Guntin
(74) *Attorney, Agent, or Firm* — Gerald E. Hespos; Michael J. Porco; Matthew T. Hespos

(57) ABSTRACT

A terminal block is provided with a conductive member including a relay portion extending in an extending direction from a device side and a connecting portion extending in a direction perpendicular to the extending direction and to be electrically connected to a mating conductive member, and a housing for integrally holding the conductive member. The housing includes a resin portion for molding the relay portion and a peripheral wall surrounding the resin portion. A sealing member is externally fit on the resin portion and the peripheral wall covers the sealing member from outside of the resin portion. A mating housing integrated with the mating conductive member is fit to the resin portion.

5 Claims, 8 Drawing Sheets

(51) Int. Cl.
*H01R 9/18* (2006.01)
*H01R 13/405* (2006.01)
*H01R 13/512* (2006.01)
*H01R 13/621* (2006.01)

(58) Field of Classification Search
USPC ..... 439/271, 345, 626
See application file for complete search history.

(56) References Cited

U.S. PATENT DOCUMENTS 8,808,026 B2 * 8/2014 Yamaguchi ..... H01R 13/5202 439/559
9,318,826 B2 * 4/2016 Kato ..... H01R 13/6273
9,647,380 B2 * 5/2017 Mukuno ..... H01R 13/5202
2012/0015546 A1 * 1/2012 Yamaguchi ..... H01R 13/05 439/370
2012/0238147 A1 9/2012 Matsumoto et al.
2012/0319513 A1 * 12/2012 Okamoto ..... H02K 5/225 310/71
2013/0040473 A1 * 2/2013 Tanaka ..... H01R 24/68 439/86
2014/0051286 A1 * 2/2014 Itsuki ..... H01R 24/20 439/587
2014/0248800 A1 9/2014 Tanaka et al.
2015/0079839 A1 * 3/2015 Takemura ..... H01R 13/74 439/559
2016/0164220 A1 * 6/2016 Kataoka ..... H01R 13/5202 439/559
2016/0308299 A1 * 10/2016 Mukuno ..... H02K 5/08
2019/0051997 A1 2/2019 Sakakura et al.
2020/0144741 A1 * 5/2020 Kudo ..... H01R 13/621

FOREIGN PATENT DOCUMENTS

JP 2013-137964 7/2013
JP 2017-045590 3/2017
JP 2017-152093 8/2017
JP 2017-157286 9/2017
JP 2017-157287 9/2017

* cited by examiner

TERMINAL BLOCK

BACKGROUND

Field of the Invention

This specification relates to a terminal block.

Related Art

Japanese Unexamined Patent Publication No. 2017-45590 discloses a terminal block to be mounted on a device. As shown in FIGS. 6 to 8 herein, this terminal block 1 includes conductive members 2 and a housing 3. The conductive members 2 are made of conductive metal and are in the form of rectangular columns whose axial centers extend straight. The housing 3 is made of nonconductive resin and has a wall-like connector fitting portion 4 integrally holding the conductive members 2 and surrounding one end of each conductive member 2. A bolt hole 5 is recessed in the one end of the conductive member 2. A wire-side terminal 6 is overlapped on the bolt hole 5 and fastened with a bolt.

Note that the wire-side terminals 6 are integrated with a housing 8 made of synthetic resin and include a wire-side fitting portion 7. The wire-side fitting portion 7 is fit into the connector fitting portion 4 of the terminal block 1.

According to the above configuration, a seal ring 9 provided on the outer periphery of the wire-side fitting portion 7 is pressed against the inside of the connector fitting portion 4 of the terminal block 1 to waterproof a space between the connector fitting portion 4 of the terminal block 1 (see FIG. 8). However, in this configuration, the seal ring 9 is exposed to outside, as shown in FIGS. 6 and 7 in the wire-side fitting portion 7 before being fit. Thus, the seal ring 9 may be damaged by external matter, collision or the like to impair waterproofness. Thus, a measure, such as the protection of the seal ring 9 before fitting by covering the seal ring 9 with vinyl, has been necessary.

This specification provides a terminal block in which a sealing member is hardly damaged even before fitting.

SUMMARY

This specification is directed to a terminal block with a conductive member including a relay portion extending in an extending direction from a device side and a connecting portion extending in a direction perpendicular to the extending direction and to be electrically connected to a mating conductive member. A housing also is provided for integrally holding the conductive member. The housing includes a resin portion for molding the relay portion and a peripheral wall surrounding the resin portion. A sealing member is fit externally on the resin portion, and the peripheral wall covers the sealing member from outside of the resin portion. A mating housing integrated with the mating conductive member is fit to the resin portion.

According to the above configuration, the sealing member is provided on the resin portion to provide waterproofing between the terminal block and the mating housing. The sealing member mounted on the resin portion is covered from outside by the peripheral wall. Specifically, the sealing member conventionally provided on the mating housing in an exposed state is provided while being protected by the peripheral wall on the terminal block side. Thus, the sealing member cannot be damaged by external matter, collision or the like even before fitting, and need not be protected with vinyl or the like.

Further, a structure for mounting the sealing member on the mating housing has been conventionally necessary. However, by providing the sealing member on the terminal block, such a structure becomes unnecessary and the mating housing can be reduced in size. Consequently, the terminal block to be fit to the mating housing can be reduced in size.

The resin portion may be provided with a groove-like sealing member mounting portion into which the sealing member is fit. According to this configuration, the deviation of the sealing member from a proper mount position on the resin portion is suppressed.

The conductive member may be in the form of a plate bent into an L shape with the connecting portion including a bolt insertion hole on one bent side and the relay portion extending in the extending direction perpendicularly to the connecting portion on the other bent side. The connecting portion and the mating conductive member may be connected by tightening a bolt, and the resin portion may be provided with a nut accommodating portion for accommodating a nut to be fastened to the bolt.

The resin portion may collectively mold multiple conductive members. By this configuration, the structure of the terminal block can be simplified even if the multiple conductive members are provided.

According to this specification, it is possible to obtain a terminal block in which a sealing member cannot be damaged even before fitting.

DETAILED DESCRIPTION

One embodiment is described with reference to FIGS. 1 to 5. A terminal block 10 of this embodiment is mounted on a case of an unillustrated device and relays and connects device-side terminals provided in the device and wire-side terminals 51 connected to ends of wires.

Figure 1:
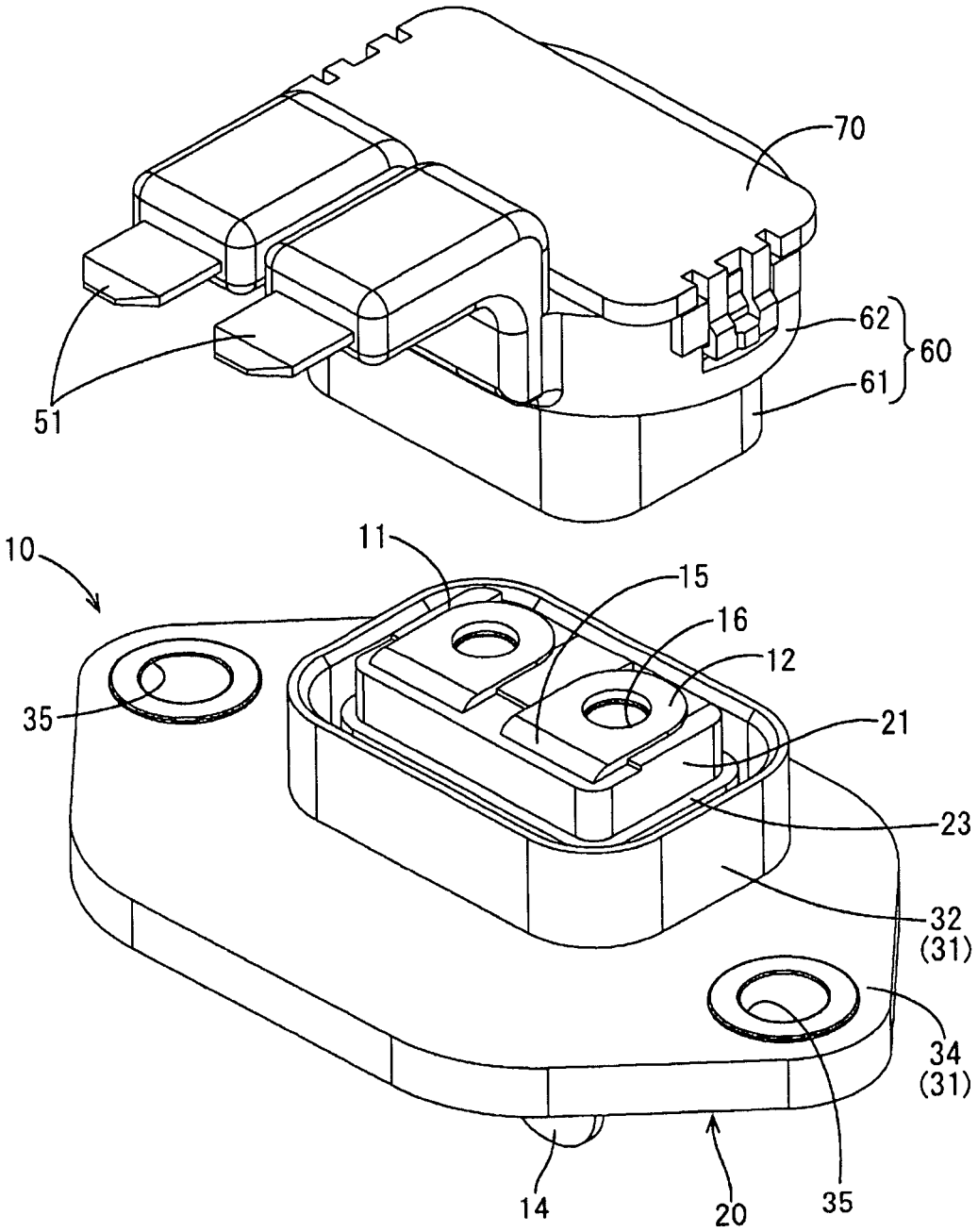
FIG. 1 is an exploded perspective view of a terminal block and a wire-side connector of one embodiment.
Figure 2:
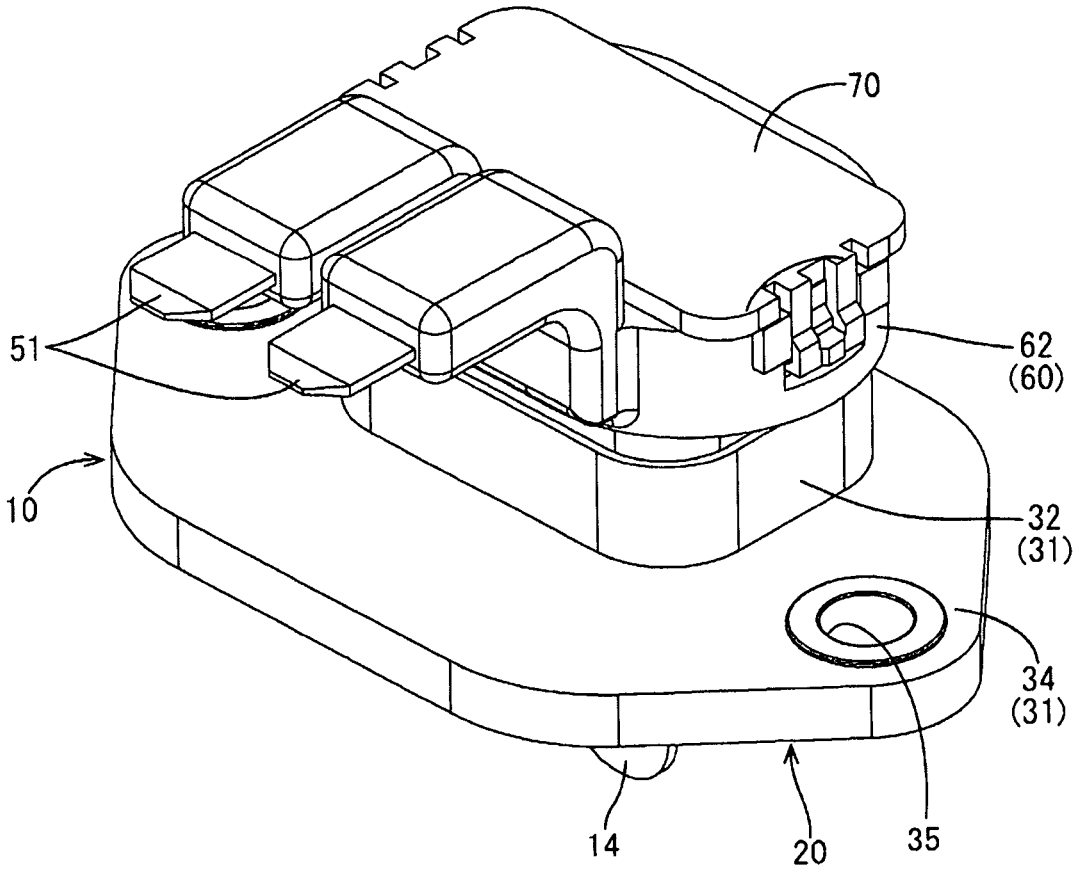
FIG. 2 is a perspective view of the terminal block and the wire-side connector in a fit state.
Figure 3:
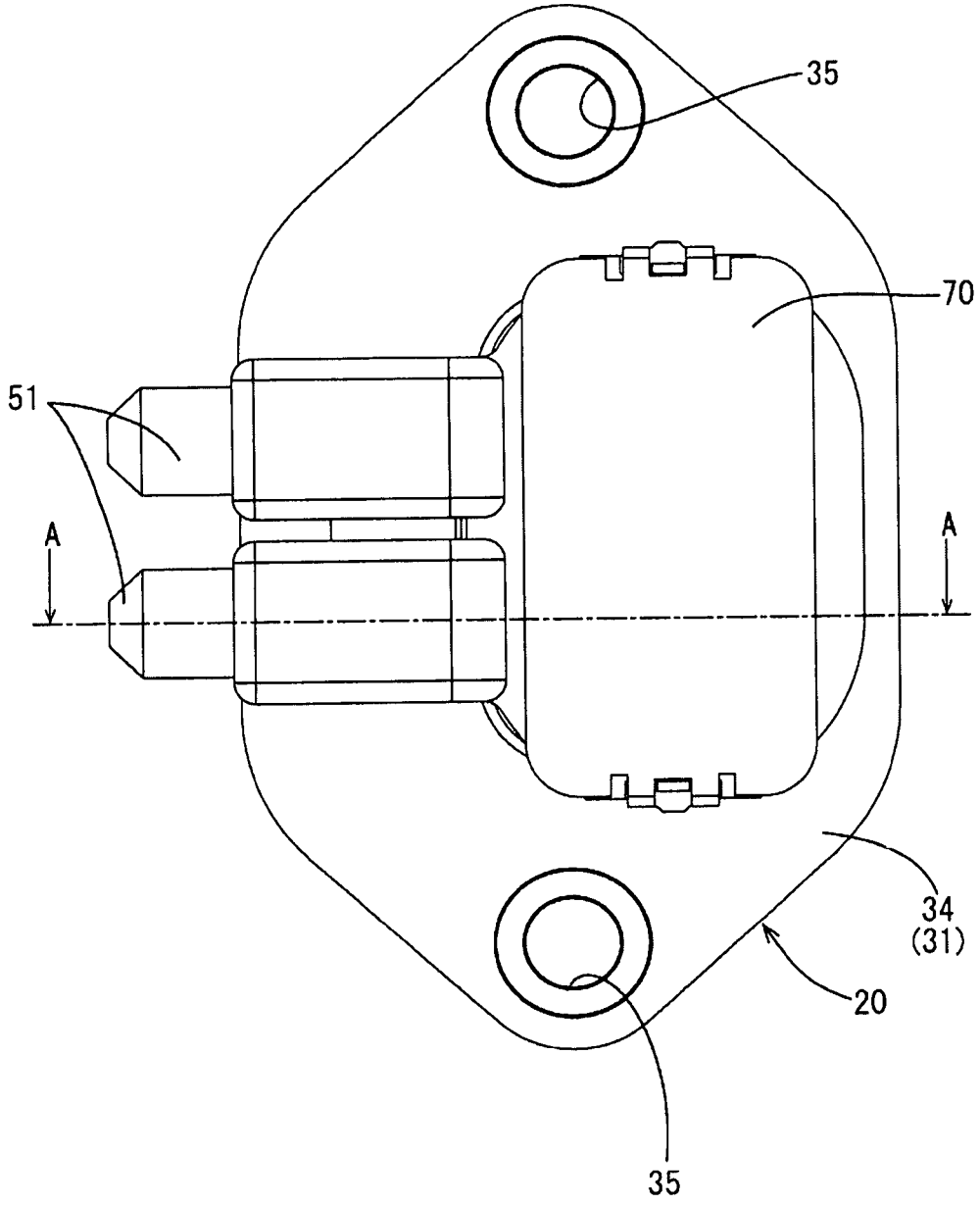
FIG. 3 is a plan view of the terminal block and the wire-side connector.
Figure 4:
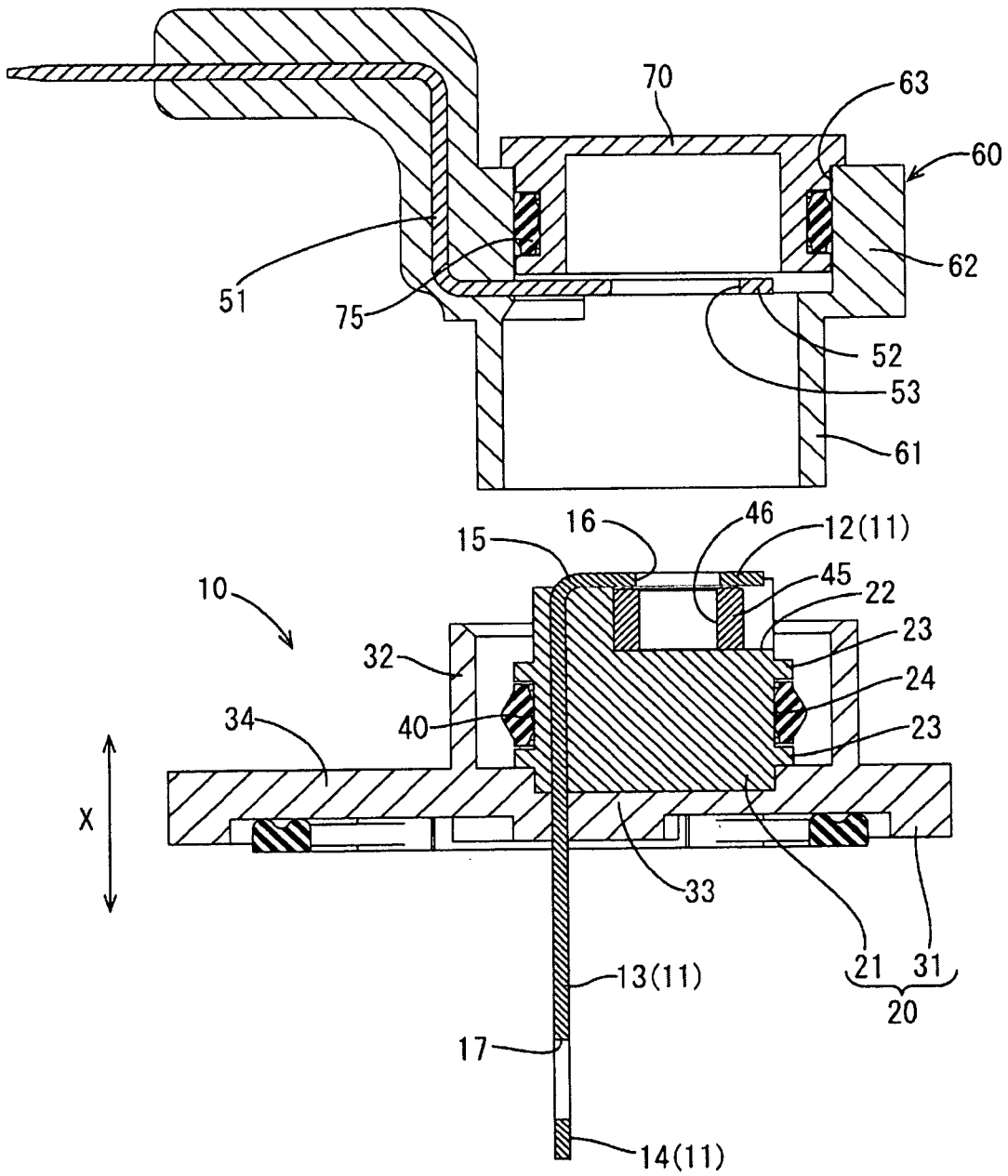
FIG. 4 is an exploded section along A-A of FIG. 3 of the terminal block and the wire-side connector.
Figure 5:
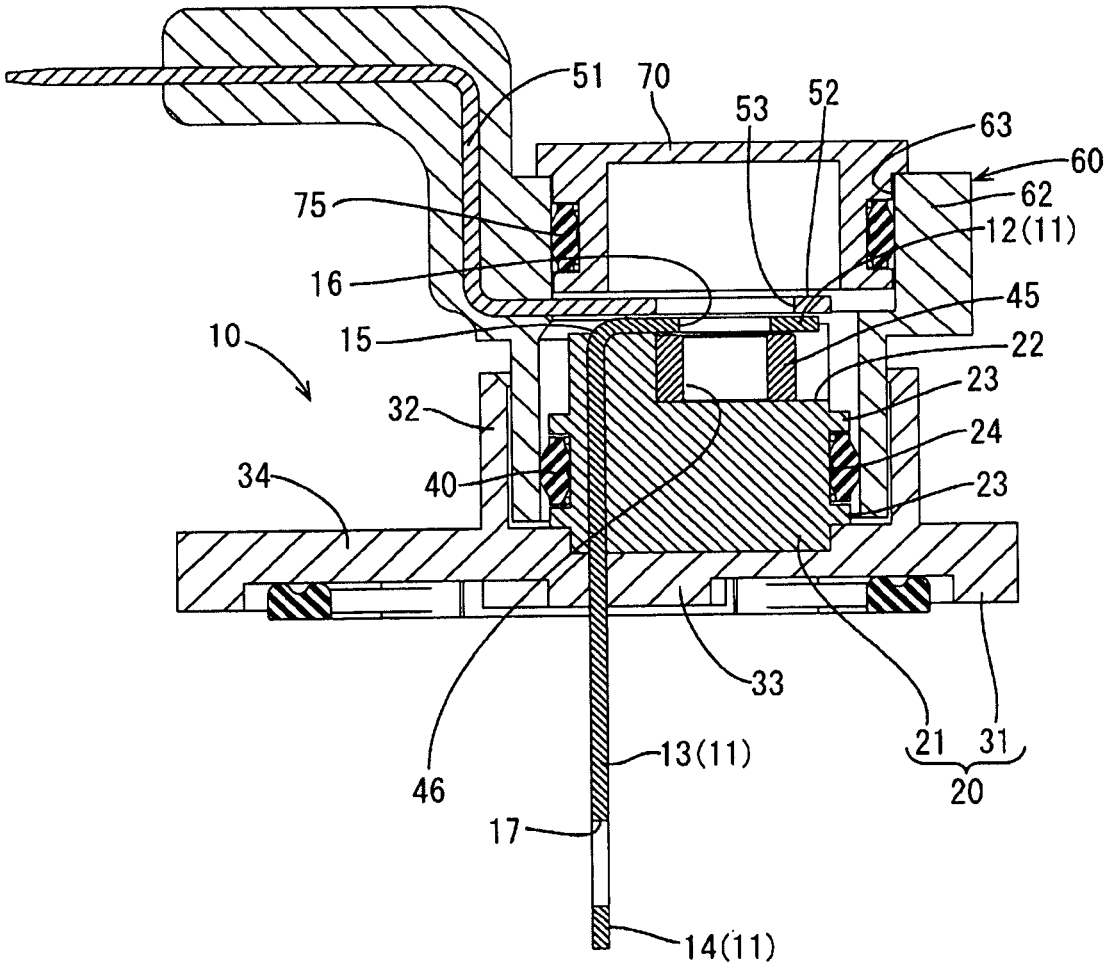
FIG. 5 is a section along A-A of FIG. 3 of the terminal block and the wire-side connector in the fit state.
Figure 6:
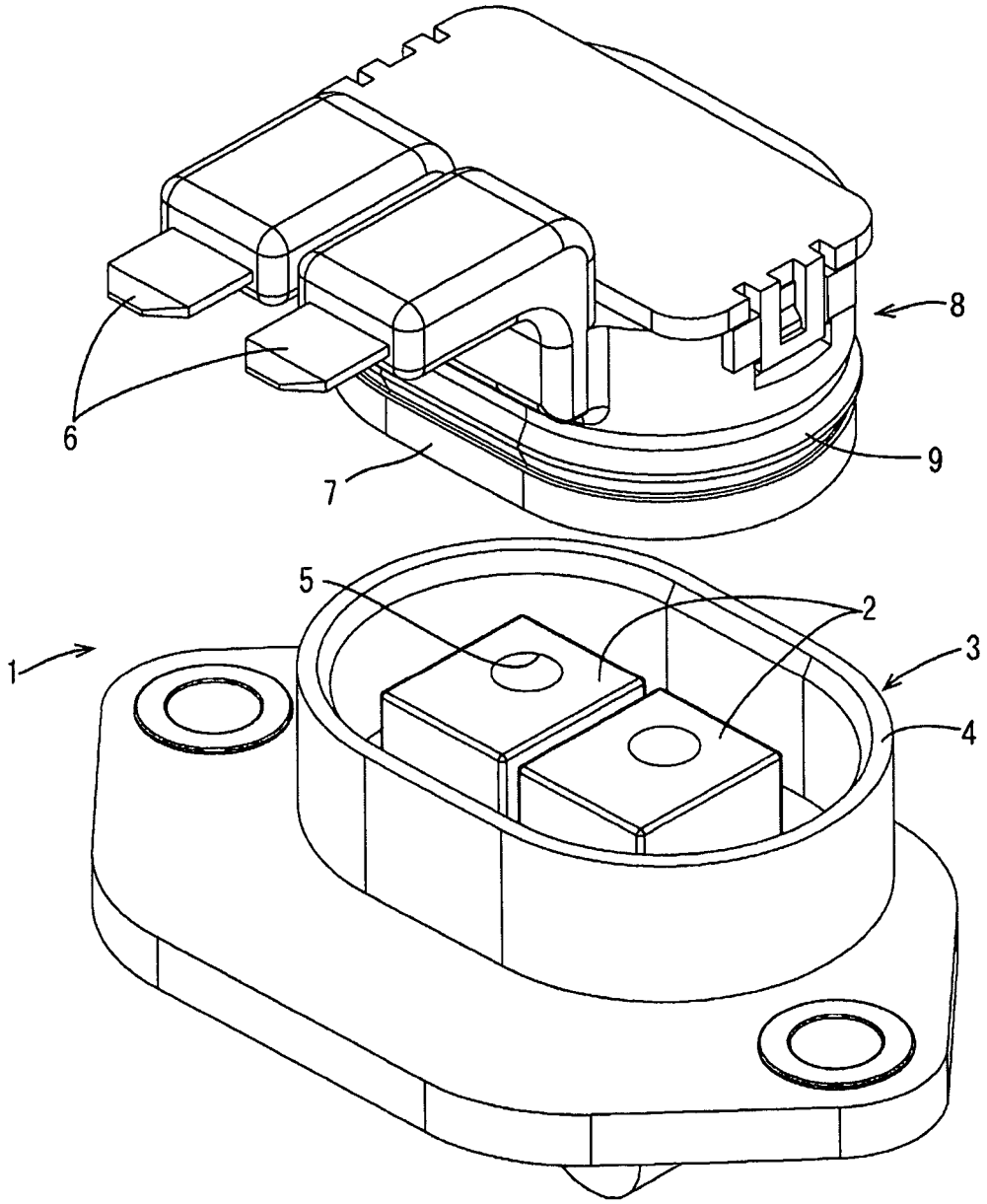
FIG. 6 is an exploded perspective view of conventional terminal block and wire-side connector.

As shown in FIG. 4, a busbar 11 is in the form of a strip plate bent into an L shape. One end side (upper side of FIG. 4) thereof serves as a first connecting portion 12 to be connected to the wire-side terminal 51, and the other end (lower side of FIG. 4) thereof serves as a second connecting portion 14 to be connected to the unillustrated device-side terminal.

A part between the first and second connecting portions 12, 14 serves as a relay portion 13 extending in a vertical direction of FIG. 4 (an example of an extending direction X).

A bent portion 15 bent at a right angle is present between the first connecting portion 12 and the relay portion 13. Thus, the first connecting portion 12 is arranged perpendicularly to the relay portion 13.

The second connecting portion 14 extends straight down from the relay portion 13. These first and second connecting portions 12, 14 are formed respectively with bolt insertion holes 16, 17 penetrating through plate surfaces, and shaft portions of bolts are inserted into the bolt insertion holes 16, 17.

The relay portion 13 of the busbar 11 is molded by a resin portion 21. The resin portion 21 is substantially in the form of a rectangular column collectively molding upper parts (near the first connecting portions 12) of the relay portions 13 of two of the busbars 11, and two of the first connecting portions 12 are exposed side by side on the upper surface of the resin portion 21. Further, areas of the resin portion 21 located below the first connecting portions 12 are open upward and laterally, and these opening parts serve as nut accommodating portions 22 for accommodating nuts 45. With the nuts 45 accommodated in the nut accommodating portion 22, a threaded hole 46 of each nut 45 and the bolt insertion hole 16 of the first connecting portion 12 are coaxial and the upper surface of each nut 45 is dimensioned to overlap the lower surface of the first connecting portion 12.

Two ribs 23 extending in a circumferential direction are provided on a side surface of the resin portion 21, and a space between these ribs 23 serves as a groove-like sealing member mounting portion 24 into which an annular sealing member 40 is fit. The sealing member 40 is positioned with respect to the resin portion 21 and held at a proper position by the sealing member mounting portion 24.

The resin portion 21 is integrated with an outer housing 31 to form a housing 20 of the terminal block 10. The outer housing 31 includes a peripheral wall 32 in the form of a rectangular tube surrounding the resin portion 21 and a back wall 33 disposed to close one end (lower side of FIG. 4) of the peripheral wall 32 in an axial direction. The relay portions 13 of the busbars 11 extend toward the device (down) through the back wall 33. Further, the back wall 33 protrudes laterally (radially outward of the peripheral wall 32) to form a flange 34, and this flange 34 is provided with two housing fixing holes 35 for tightening bolts into fixing holes (not shown) provided in the case of the device.

The peripheral wall 32 is provided at a predetermined distance from the side surface of the resin portion 21, and a rise height thereof from the flange 34 is set at a height lower than a rise height of the resin portion 21 from the flange 34 and higher than the sealing member mounting portion 24 (height to cover the sealing member mounting portion 24 from outside) (see FIG. 4).

In this embodiment, the resin portion 21 is formed by performing primary molding on the busbars 11 bent into an L shape, and the housing 20 of the terminal block 10 in which the resin portion 21 and the outer housing 31 are integrated is formed by performing secondary molding on the resin portion 21 with the sealing member 40 externally fit on the resin portion 21 and the nut 45 accommodated in the nut accommodating portion 22.

On the other hand, the wire-side terminal 51 is in the form of a cranked strip plate, and one end (right side of FIG. 4) thereof serves as a wire-side connecting portion 52 to be overlapped on the first connecting portion 12 of the busbar 11. The wire-side connecting portion 52 is formed with a wire-side insertion hole 53 which is disposed to overlap the bolt insertion hole 16 of the first connecting portion 12 to allow the insertion of the shaft of the bolt with the wire-side connecting portion 52 overlapped on the first connecting portion 12 of the busbar 11.

The wire-side terminal 51 is molded integrally to a wire-side housing 60 made of synthetic resin to form a wire-side connector 50. The wire-side housing 60 includes a wire-side fitting 61 substantially in the form of a rectangular tube open in the vertical direction and to be fit to the terminal block 10. Inner dimensions of the wire-side fitting 61 are set so that the wire-side fitting portion 61 is fit externally to the resin portion 21 having the sealing member 40 mounted thereon. Specifically, the wire-side fitting 61 is fit to the resin portion 21 of the terminal block 10 and, in a fit state, the sealing member 40 externally fit on the resin portion 21 is pressed against the inner surface of the wire-side fitting 61 (see FIG. 5). In this way, waterproofness between the terminal block 10 and the wire-side housing 60 is ensured.

Note that the peripheral wall 32 is provided at such a position as to extend along the outer surface of the wire-side fitting 61 with almost no clearance therebetween with the wire-side fitting 61 fit to the resin portion 21. Further, the wire-side terminals 51 extend inward of the wire-side fitting 61 in a direction perpendicular to an axial direction of the wire-side fitting 61 at positions to be overlapped on the first connecting portions 12 of the busbars 11 with the wire-side fitting 61 externally fit to the resin portion 21.

An upper side (side opposite to the terminal block 10) of the wire-side fitting 61 is formed into a rectangular tube shape enlarged in dimensions via a step from the wire-side fitting 61 and serves as an accommodating portion 62 for accommodating heads of the bolts (not shown) for fastening the wire-side connecting portions 52 to the nuts 45 together with the first connecting portions 12 of the busbars 11. The upper end of this accommodating portion 62 serves as an opening 63 for a fastening operation, and the opening 63 can be opened and closed by a service cover 70. Note that a seal ring 75 also is provided between the accommodating portion 62 (wire-side housing 60) and the service cover 70, and the inside of the wire-side fitting 61 is held in a waterproofed state.

According to the terminal block 10 of this embodiment as just described, the sealing member 40 for providing waterproofing between the terminal block 10 and the wire-side housing 60 (wire-side fitting 61) is provided on the resin portion 21, and the sealing member 40 mounted on the resin portion 21 is covered from outside by the peripheral wall 32. Specifically, a sealing member conventionally provided on a wire-side housing in an exposed state is provided while being protected by the peripheral wall 32 on the side of the terminal block 10. Thus, the sealing member 40 is not likely damaged by an external matter, collision or the like even before fitting, and need not be protected with vinyl or the like.

Figure 7:
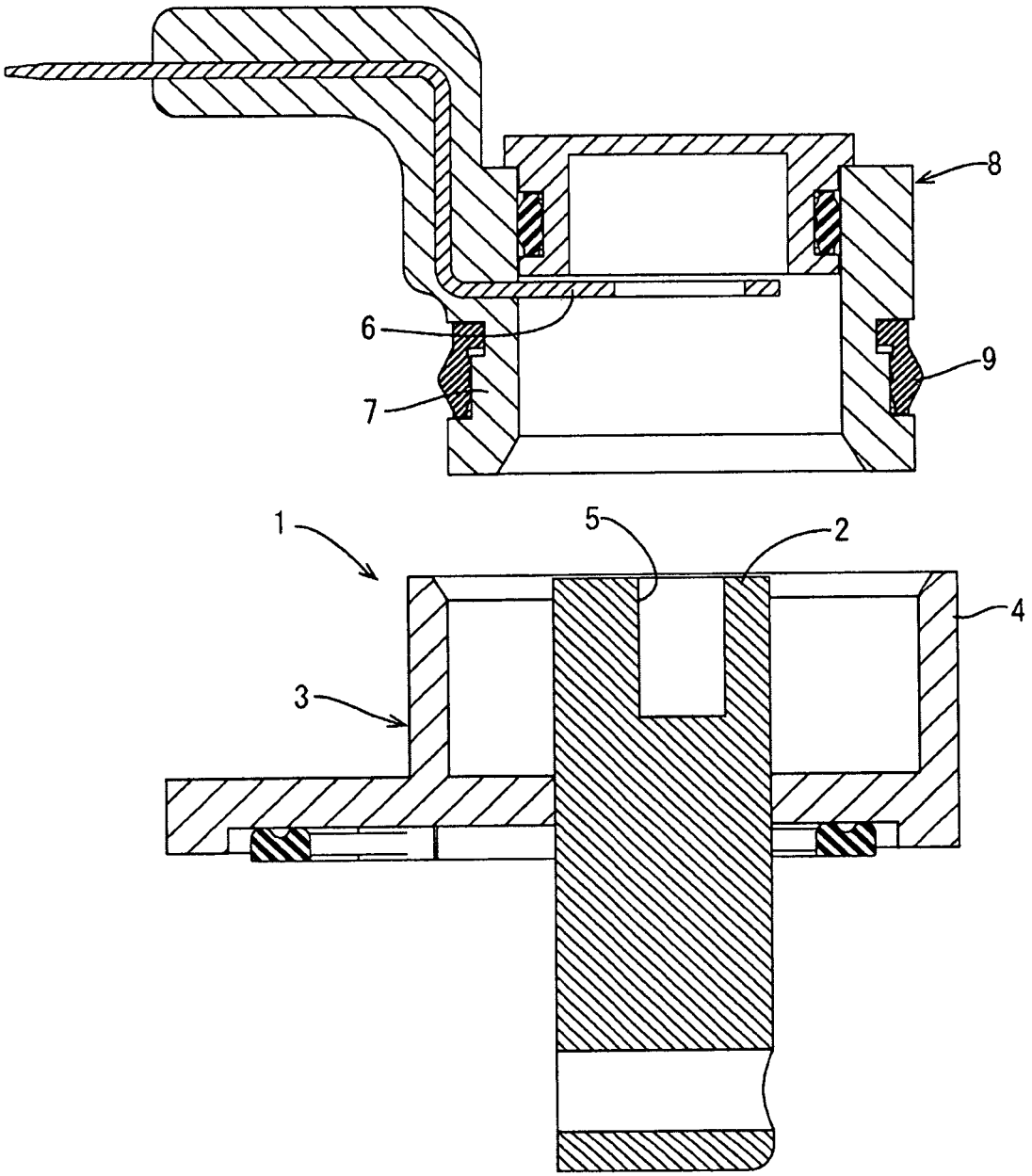
FIG. 7 is an exploded perspective view of the conventional terminal block and wire-side connector.
Figure 8:
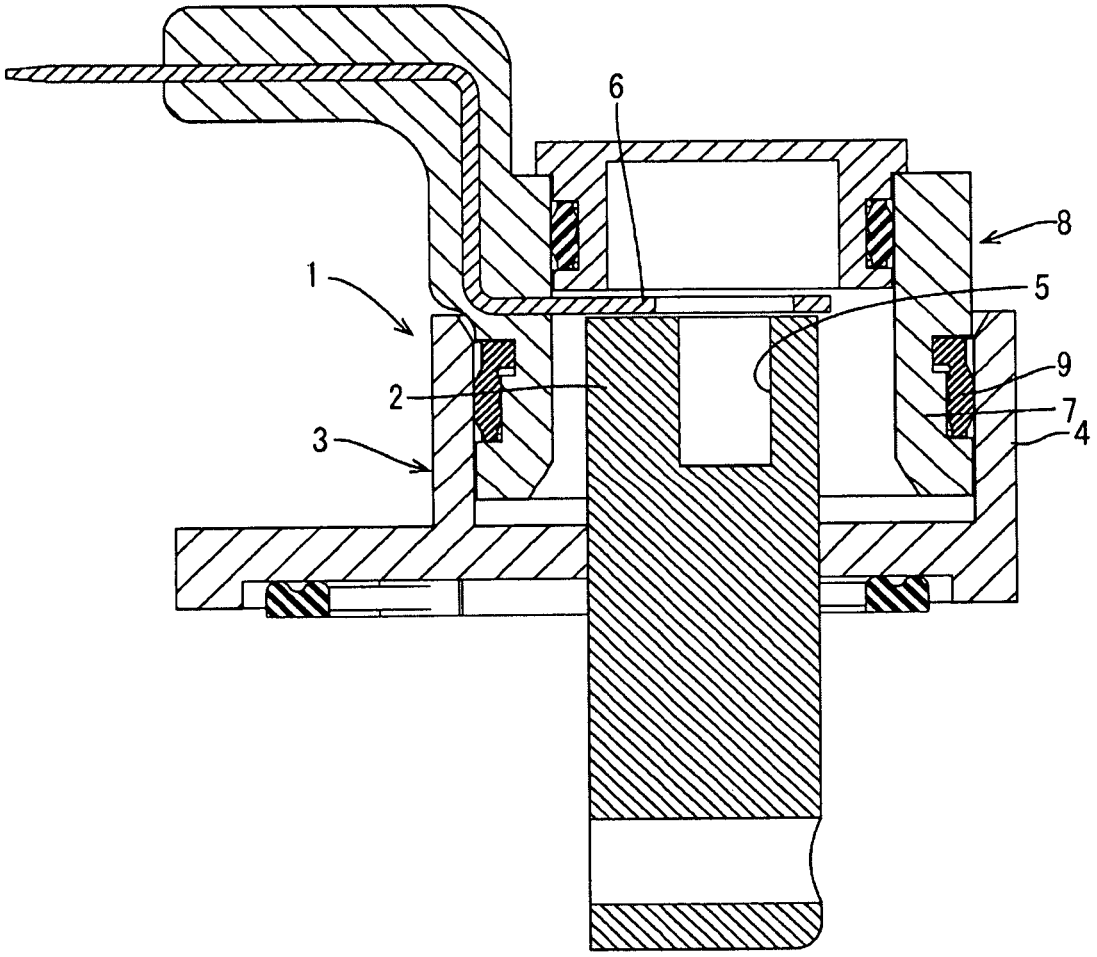
FIG. 8 is a section of the conventional terminal block and wire-side connector in a fit state.

Further, a structure for mounting the sealing member on the wire-side housing conventionally has been necessary. However, by providing the sealing member 40 on the side of the terminal block 10, such a structure becomes unnecessary and the wire-side housing can be reduced in size. Specifically, in the prior art shown in FIG. 7, the wire-side fitting 7 has to be thick to mount the seal ring 9 on the wire-side fitting 7. However, in this embodiment, the wire-side fitting 61 can be thinned, as shown in FIG. 4, since a seal ring is not necessary. Moreover, the wire-side fitting 61 is fit externally not to the peripheral wall 32, but to the resin portion 21. Thus, dimensions of the wire-side fitting 61 and dimensions of the peripheral wall 32 of the terminal block 10 for surrounding the wire-side fitting 61 can also be made smaller than before. Specifically, the terminal block 10 itself to be fit to the wire-side housing 60 can be reduced in size.

Further, since the resin portion 21 is provided with the groove-like sealing member mounting portion 24 into which the sealing member 40 is fit, the deviation of the sealing member 40 from a proper mount position on the resin portion 21 is suppressed.

Further, since the resin portion 21 collectively molds the plurality of busbars 11, the structure of the terminal block 10 can be simplified as compared to a configuration for individually molding the plurality of busbars 11.

The invention is not limited to the above described and illustrated embodiment. For example, the following various modes are also included.

Although the conductive member is the busbar 11 bent into an L shape in the above embodiment, the conductive member may be a rod material. In that case, a bolt hole may be recessed on one end side of the rod material and the wire-side terminal and the rod material may be fastened with a bolt.

Although the bolt insertion hole 17 on the device side penetrates in the direction perpendicular to the extending direction X of the relay portion 13 of the busbar 11 in the above embodiment, a connecting portion on the device side may be in another form.

Although the groove-like sealing member mounting portion 24 is formed by providing the ribs 23 on the outer surface of the resin portion 21 in the above embodiment, a groove-like sealing member mounting portion may be formed by forming a recess recessed from the outer surface of a resin portion.

Further, the sealing member mounting portion can be omitted.

Although the resin portion 21 is formed by performing primary molding on the busbars 11 bent into an L shape in advance in the above embodiment, primary molding may be performed on straight busbars before being bent and the busbars may be bent to overlap on nuts after the nuts are accommodated into nut accommodating portions.

LIST OF REFERENCE SIGNS

10: terminal block
11: busbar (conductive member)
12: first connecting portion (connecting portion)
13: relay portion
14: second connecting portion
16, 17: bolt insertion hole
20: housing
21: resin portion
22: nut accommodating portion
24: sealing member mounting portion
31: outer housing
32: peripheral wall
40: sealing member
45: nut
51: wire-side terminal (mating conductive member)
52: wire-side connecting portion
60: wire-side housing (mating housing)
61: wire-side fitting portion
X: extending direction

The invention claimed is:

1. A terminal block, comprising:

a conductive member including a relay portion extending in an extending direction from a device side and a connecting portion extending in a direction perpendicular to the extending direction and to be electrically connected to a mating conductive member; and a housing for integrally holding the conductive member, wherein:

the housing includes a resin portion for molding the relay portion and a peripheral wall surrounding the resin portion, the resin portion having a side surface extending in the extending direction and a groove-like sealing member mounting portion recessed into the side surface in the direction perpendicular to the extending direction, a sealing member is externally fit in the groove formed in the resin portion and the peripheral wall covers the sealing member from outside of the resin portion, and a mating housing integrated with the mating conductive member is fit to the resin portion.

2. The terminal block of claim 1, wherein:

the conductive member is in the form of a plate bent into an L shape with the connecting portion including a bolt insertion hole on one bent side and the relay portion extending in the extending direction perpendicularly to the connecting portion on the other bent side, the connecting portion and the mating conductive member are connected by tightening a bolt, and the resin portion is provided with a nut accommodating portion for accommodating a nut to be fastened to the bolt.

3. The terminal block of claim 2, wherein the resin portion collectively molds a plurality of the conductive members.

4. The terminal block of claim 1, wherein:

the conductive member is in the form of a plate bent into an L shape with the connecting portion including a bolt insertion hole on one bent side and the relay portion extending in the extending direction perpendicularly to the connecting portion on the other bent side, the connecting portion and the mating conductive member are connected by tightening a bolt, and the resin portion is provided with a nut accommodating portion for accommodating a nut to be fastened to the bolt.

5. The terminal block of claim 1, wherein the resin portion collectively molds a plurality of the conductive members.

* * * * *